United States Patent [19]

Rose et al.

[11] 3,978,968

[45] Sept. 7, 1976

[54] ARTICLE HANDLING SYSTEM

[75] Inventors: Richard S. Rose, Schenectady, N.Y.; Burton P. Clark, St. George, Vt.

[73] Assignee: General Electric Company, Burlington, Vt.

[22] Filed: Oct. 24, 1974

[21] Appl. No.: 517,535

Related U.S. Application Data

[62] Division of Ser. No. 377,396, July 9, 1973, Pat. No. 3,868,884.

[52] U.S. Cl. ..... 198/339; 198/608; 198/481

[51] Int. Cl.[2] ..... B65G 47/52

[58] Field of Search ..... 89/11, 12, 13, 33 MC, 89/33 BA, 33 BC, 33 CA, 33 BB; 198/19, 25

[56] References Cited

UNITED STATES PATENTS 3,618,454 11/1971 Christenson ..... 89/33 BB 3,741,069 6/1973 Stewart et al. ..... 89/33 CA

*Primary Examiner*—Stephen C. Bentley

*Attorney, Agent, or Firm*—Bailin L. Kuch

[57] ABSTRACT

An article handling system is provided which includes means to receive a series of articles progressively, continuously, and at minimum linear acceleration; means to distribute the articles to a plurality of work stations progressively, continuously, and at minimum linear acceleration; to halt each article at a respective work station for a given period; and to withdraw the articles progressively, continuously, and at minimum linear acceleration.

6 Claims, 34 Drawing Figures

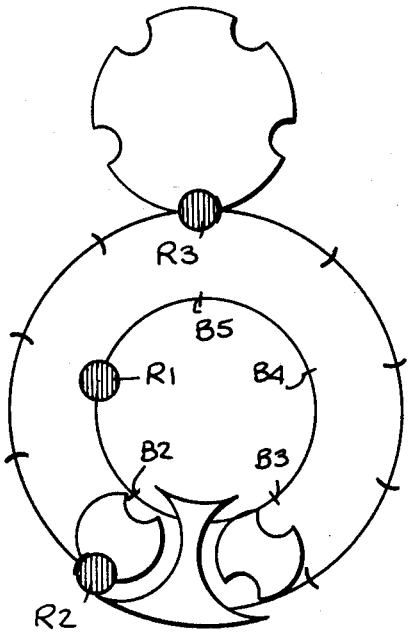
Fig. 9.
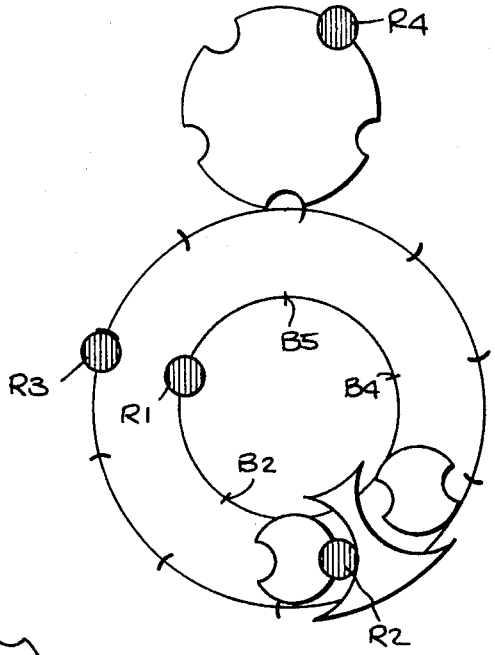
Fig. 10.
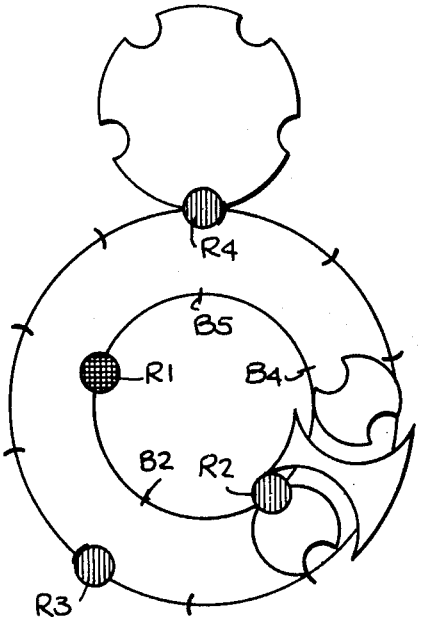
Fig. 11.
Fig. 12.
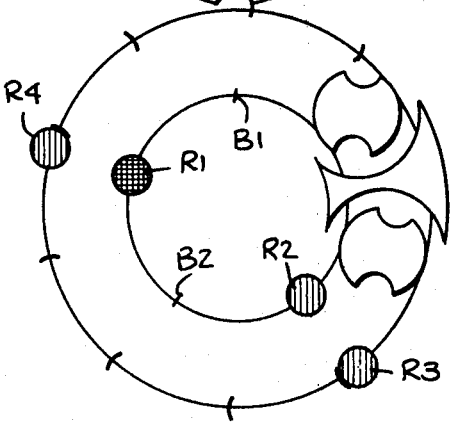
Fig. 13.
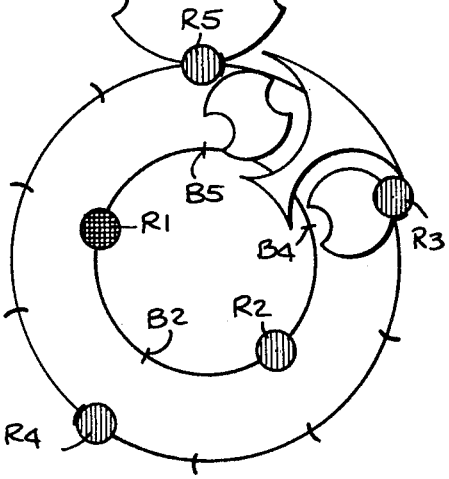

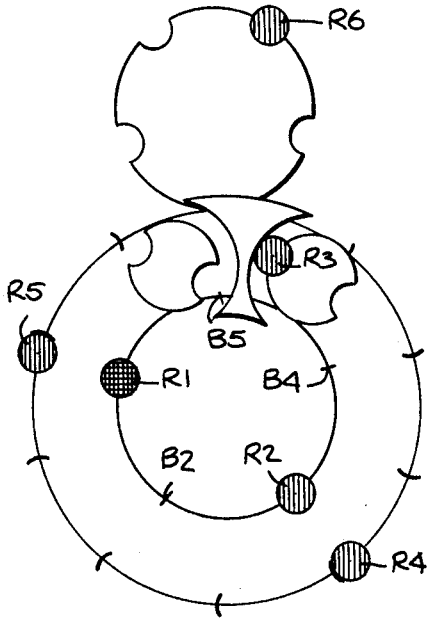
Fig.14.
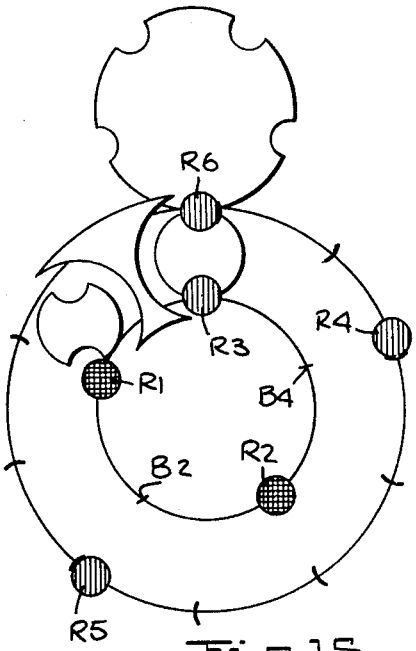
Fig.15.
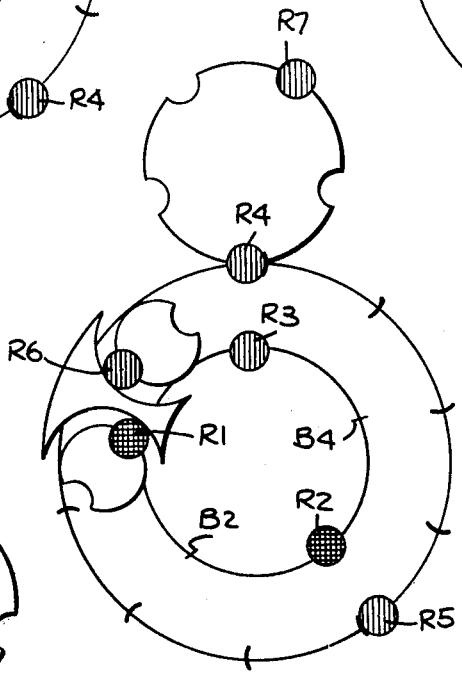
Fig.16.
Fig.17.
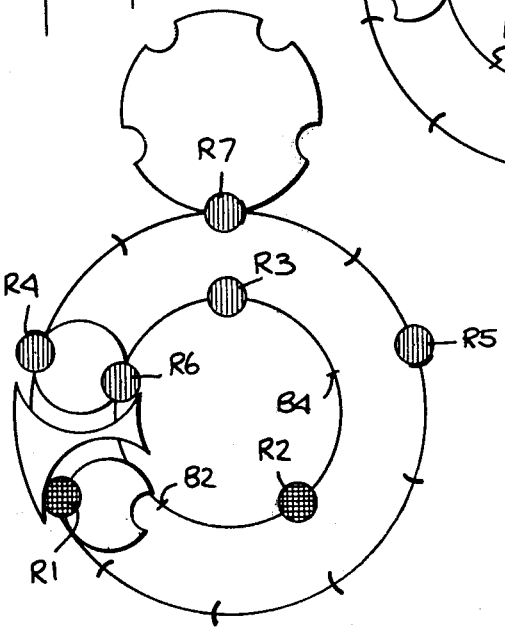
Fig.18.
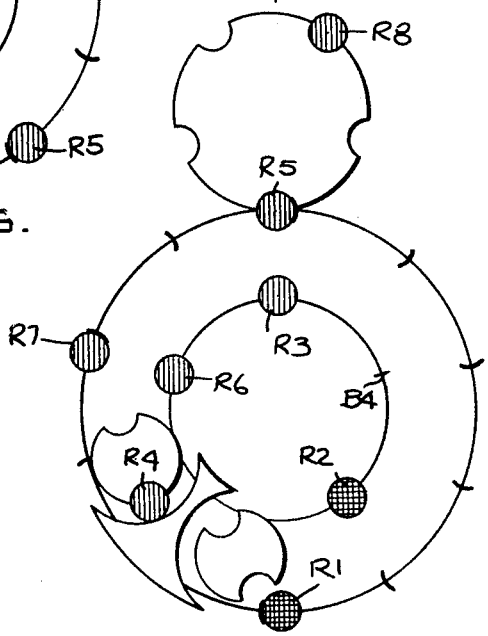

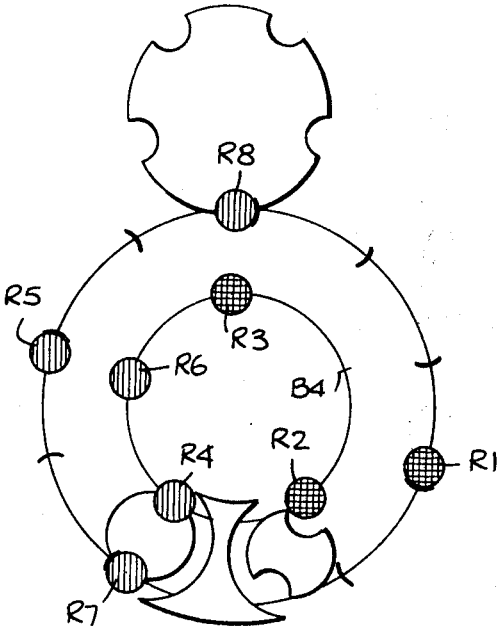
Fig. 19.
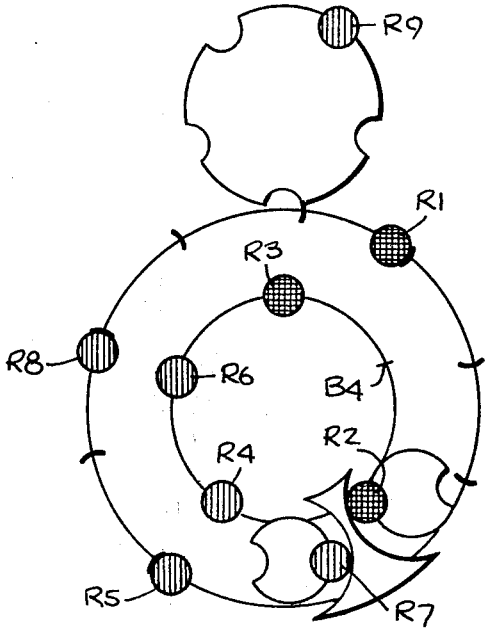
Fig. 20.
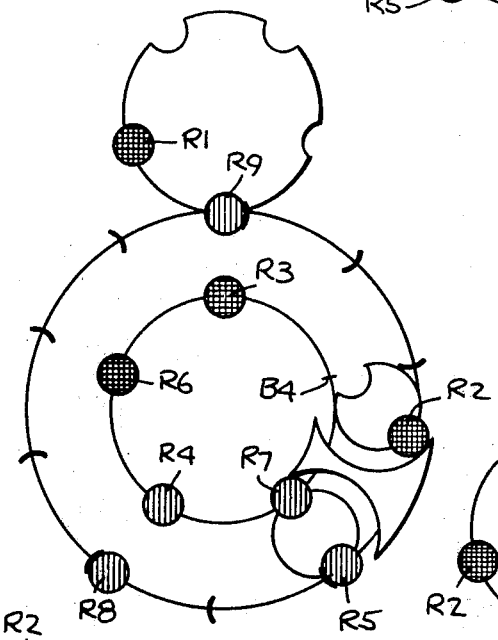
Fig. 21.
Fig. 22.
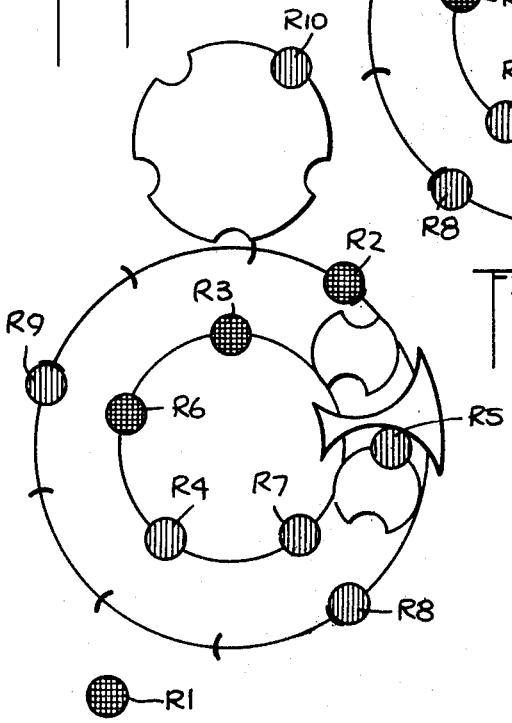
Fig. 23.
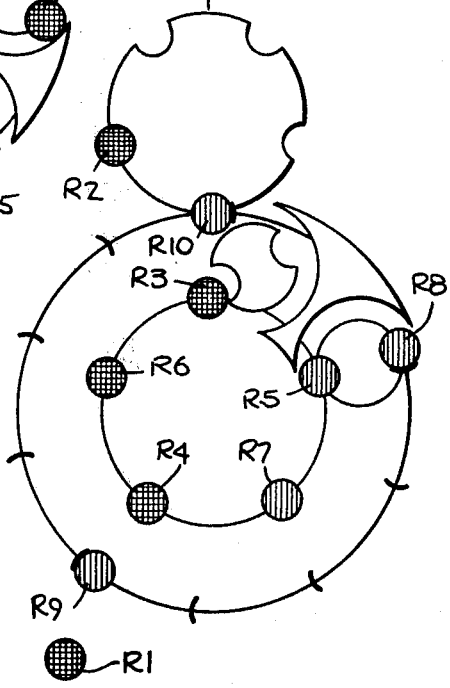

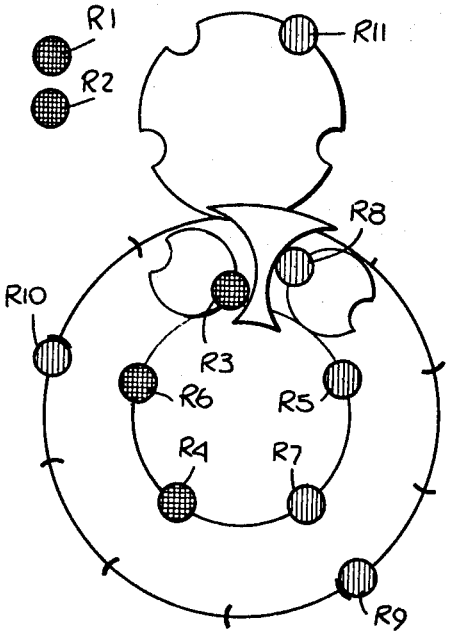
Fig. 24.
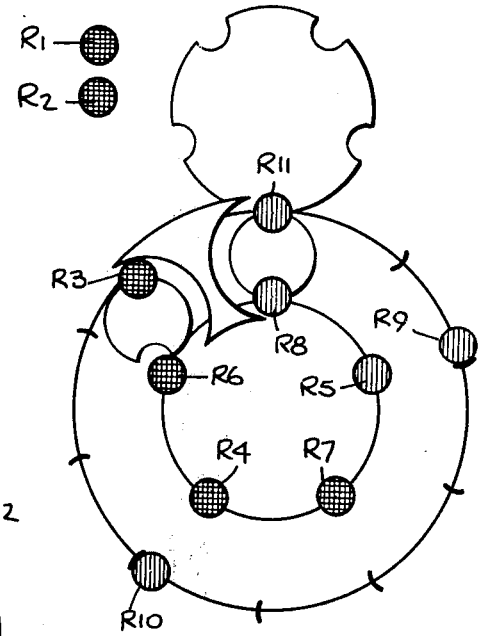
Fig. 25.
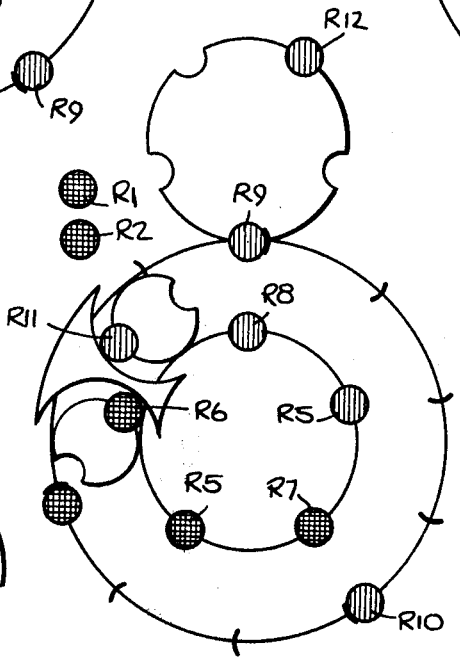
Fig. 26.
Fig. 27.
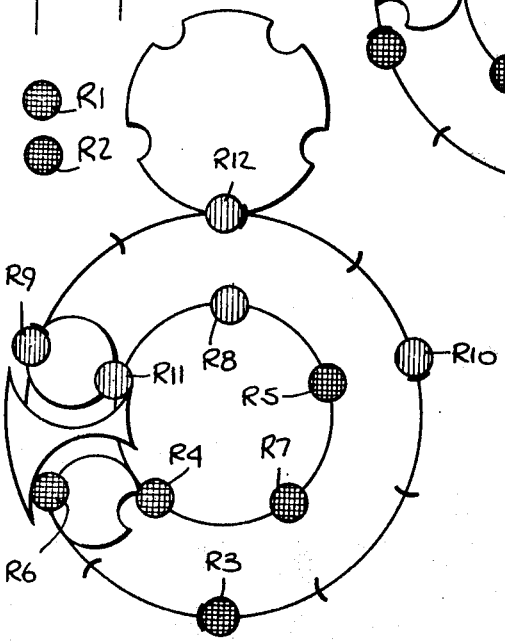
Fig. 28.
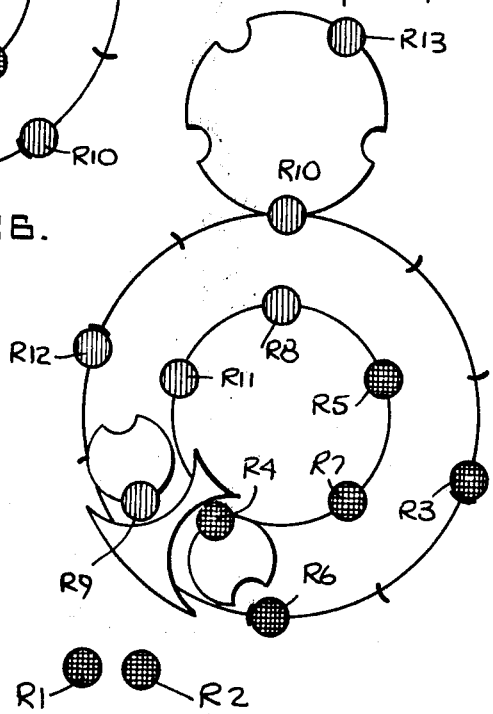

ARTICLE HANDLING SYSTEM

This is a division of application Ser. No. 377,396, filed July 9, 1973, and issued on Mar. 4, 1975 as U.S. Pat. No. 3,868,884.

BACKGROUND OF THE INVENTION

1. Field of the Invention

This invention relates to an improved article handling system, especially adapted to progressively and continuously advance a series of articles to and from a plurality of work stations, at which each article, in turn, is halted for a predetermined period of time. An embodiment is shown directed to an ammunition feed system for a battery gun.

2. Prior Art

In U.S. Pat. No. 125,563 issued Apr. 9, 1872 to R. S. Gatling, there is shown the classic modern revolving battery gun. A stationary main cam is in a housing which encloses and supports a rotating receiver assembly which has a plurality of barrels and a like plurality of chambers and bolts. Rounds of ammunition are serially passed through the housing and are handed to each bolt in turn as it passes the feeding station. This principle of operation has become conventional, as shown, for example, in U.S. Pat. No. 2,849,921 issued Sept. 2, 1958 to H. McC. Otto and in U.S. Pat. No. 3,380,343 issued Apr. 30, 1968 to R. E. Chiabrandy et al. Another battery gun approach having a plurality of stationary barrels, a like plurality of independent ammunition supplies, and a rotating transfer mechanism is shown in U.S. Pat. No. 563,701, issued July 7, 1896 to E. Wilder. Yet another approach, having a plurality of stationary barrels, a revolving plurality of chambers, and a rotating charge wheel operating within a spiral charging cam track, is shown in U.S. Pat. No. 2,959,106, issued Nov. 8, 1960 to J. F. O'Brien. Still another approach is shown in U.S. Pat. No. 3,722,356 issued March 27, 1973 to D. P. Tassie et al. Here a plurality of stationary barrels with respective bolts are fed in sequence by a rotating distributor which was itself fed by a single train of cartridges. Shifting of the cartridges between the distributor and the bolts is affected by an intermittently operated, rectilinear-radially travelling, transfer mechanism.

SUMMARY OF THE INVENTION

It is an object of this invention to provide an improved system of the type shown in U.S. Pat. No. 3,722,356 above mentioned.

It is a further object to provide such a system which minimizes the linear accelerations which are imposed on the rounds of ammunition during their transfer to and between the distributor and the bolts.

A feature of this invention is the provision of an article handling system including means to receive a series of articles progressively, continuously and at minimum linear acceleration; means to distribute the articles to a plurality of work stations progressively, continuously and at minimum linear acceleration, to halt each article at a respective work station for a given period, and to withdraw the articles progressively, continuously and at minimum linear acceleration.

BRIEF DESCRIPTION OF THE DRAWING

These and other objects, features and advantages of the invention will be apparent from the following specification thereof taken in conjunction with the accompanying drawing in which:

FIG. 3 is a view in transverse cross-section of the gun in FIG. 2 taken along the plane III—III;

FIGS. 4 through 34 are schematic views illustrating the cycle of operation of the disclosed embodiment.

DESCRIPTION OF THE PREFERRED EMBODIMENT

Figure 8:
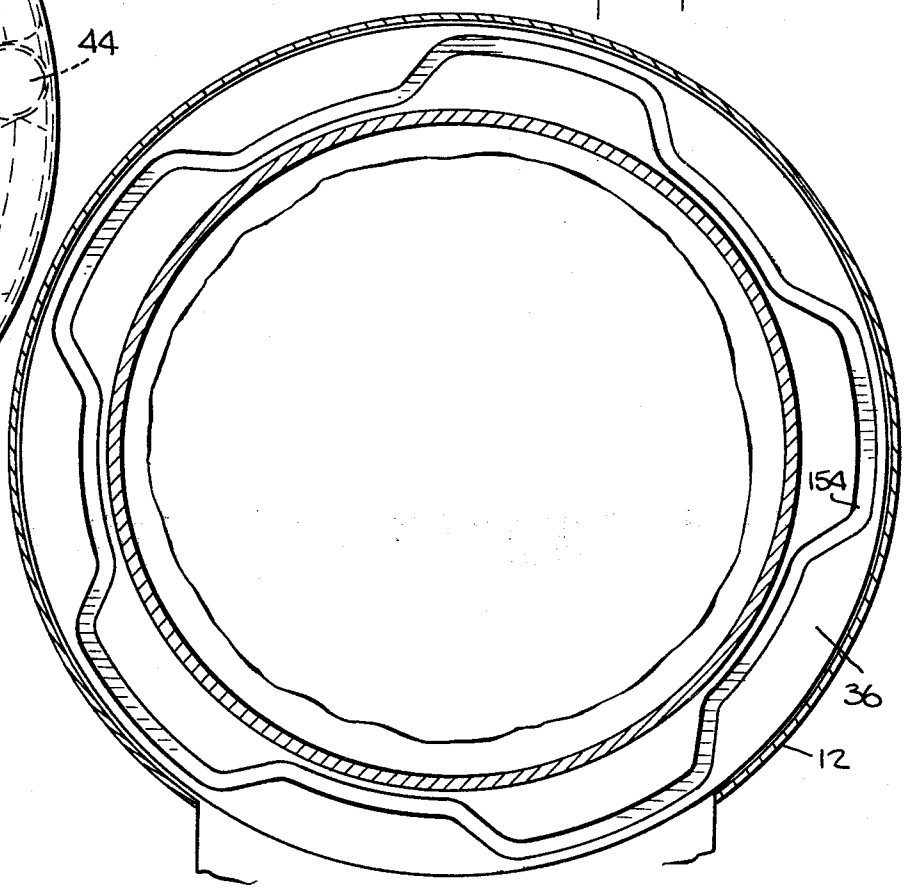
Figure 1:
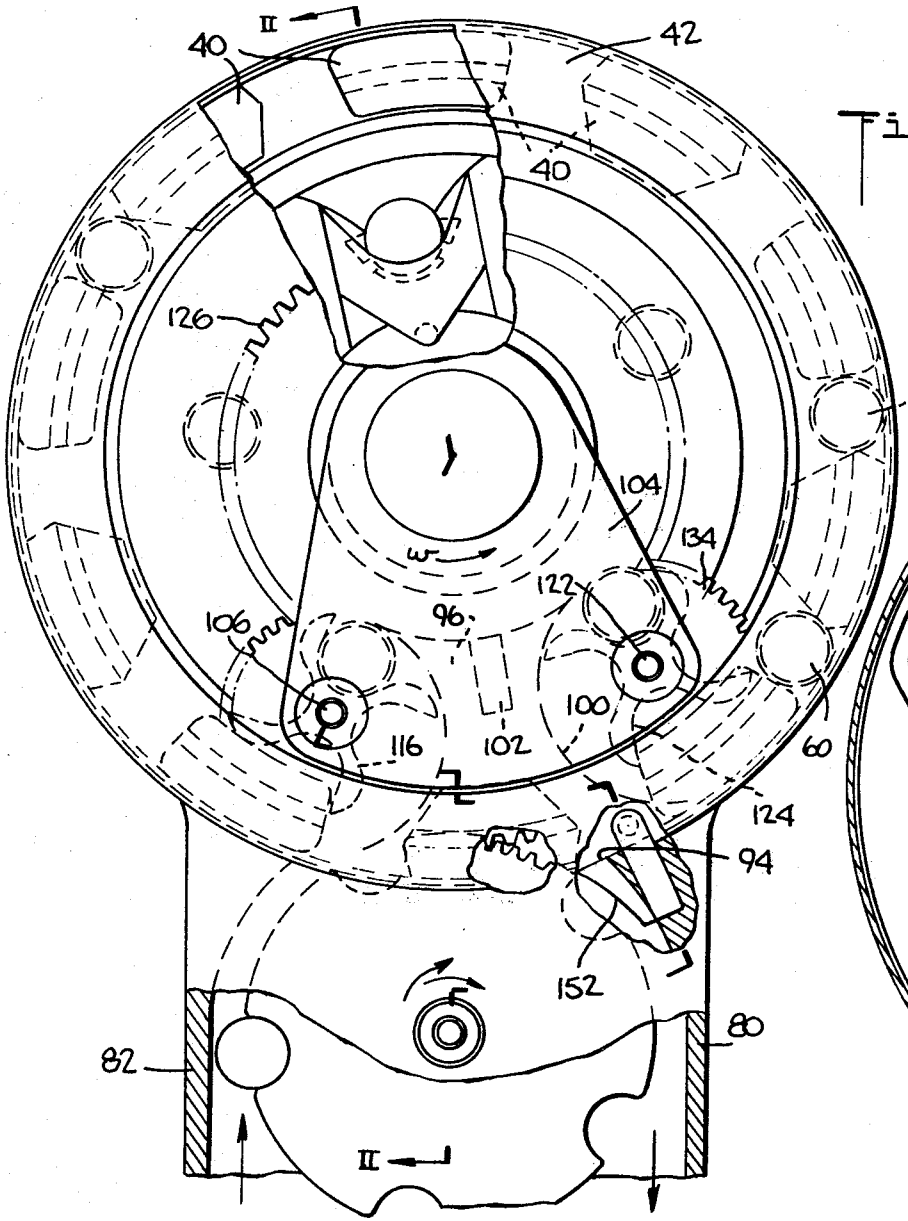
FIG. 1 is a view in transverse cross-section of a "non-rotating" Gatling type gun embodying this invention.

The embodiment shown is a non-rotating, Gatling type gun of the type shown in U.S. Pat. No. 3,722,356. Two rolling sprockets are used to transfer the rounds from the annular distributor ring to the barrels and return. The first sprocket transfers each fired case from the respective gun bolt to the distributor ring. The second sprocket transfers each fresh round from the distributor ring to the respective gun bolt. A feed sprocket and an oscillating guide, in conjunction, are used to hand off fresh rounds to the distributor ring and to pick off fired cases from the distributor ring.

The gun includes a stationary housing 10 having integral therewith a stationary aft cover 12, a stationary receiver 14 with a plurality, here shown as five in number, of barrels 16, also identified as B1, B2, B3, B4 and B5. Each of the barrels has a respective bore 18 and a chamber 20. A respective bolt guide slot 22 is aligned with each barrel and carries a respective gun bolt 24.

A cylindrical drum 26 is journaled to the housing by fore and aft bearings 28 and 30 respectively. The drum 26 has a conventional helical cam track 32 which receives the respective cam followers 34 of the gun bolts 24, so that as the drum 26 is rotated about the receiver 14, the cam track 32 acts upon the followers 34 to reciprocate the gun bolts fore and aft.

A distributor or retainer ring 36 is journaled to the housing 10 by fore and aft bearings 37 and 38 respectively. The ring has a plurality, here shown as ten, of retainer vanes 40, providing a like plurality of passageways or pockets 42. Each passageway is adapted to receive a round 44 of ammunition, is open centrifugally and centripetally, and is closed fore and aft by ring surfaces 46 and 48 respectively. Each passageway is bounded centrifugally by the inner surface 50 of the cover 12; and is bounded centripetally by the peripheral surfaces 52 and 54 of the annular guides 56 and 58 respectively, except in the areas interrupted by feeder and ejection sprockets and guides, which are integral with the drum 26. Each passageway is also adapted to receive a fired case 60.

An inner drive tube 62 is journaled to the stationary receiver 14 by fore and aft bearings 64 and 66 respectively. The forward face 68 of the tube 62 has a cam track 70 which receives the cam followers 72 of a plurality of bolt lock cross slides 74, one for each gun bolt 24. The locking system is similar to that shown in U.S. Pat. No. 3,690,215 issued to B. P. Clark et al. on Sept. 12, 1972, however, the cross-slide encompasses less than 360° of the periphery of the bolt to provide clearance for the nose of the round being handed to the bolt, thereby permitting a relatively short aft travel of the bolt for loading.

The housing 10 further includes a feeder passageway defined by a forward wall 76, an aft wall 78, a right wall 80 and a left wall 82. A feeder shaft 84 is journaled to and between the forward and aft walls by fore and aft bearings 86 and 88 respectively. A two plate feeder sprocket 90 is fixed to the shaft 84 and has an odd number, here shown as five, of round receiving cavities 92.

A guide vane assembly 96 has a transverse forward plate 98 and a transverse aft plate 100 fixed, by means of a longitudinally extending web 102, to the cylindrical drum 26.

A traveling feed sprocket shaft 106 is journaled to the cylindrical drum 26 by a fore bearing 108, an intermediate bearing 110, and an aft bearing 112, and is journaled to the drive tube sector 104 by a bearing 114. A travelling two plate feed sprocket 116, having a foreward plate 118 and an aft plate 120, is fixed to the shaft 106. A traveling eject sprocket shaft 122 is similarly journaled to the cylindrical drum 26 and to the drive tube sector 104. A traveling two plate feed sprocket 124 is similarly fixed to the shaft 122.

A stationary sun gear 126 is fixed to the aft end of the stationary housing 14. A double planetary gear is fixed on the feeder sprocket shaft 106 and has a forward gear 128 meshed with the sun gear 126 and an aft gear 130. An inner ring gear 132 is integral with the aft end of the distributor ring 36 and is meshed with the gear 130. A similar double planetary gear 134 is fixed on the eject sprocket shaft and is meshed between the sun gear 126 and the ring gear 132. A gear 136 is fixed to the feeder shaft 84 and is meshed with an external ring gear 138 integral with the distributor ring 36.

An oscillating guide 140 is disposed in a pocket 142 in the right wall 80 of the stationary housing 10. The guide has a forward plate 144, an aft plate 146, and an aft arm 148 which has a cam follower roller 150. Each of the plates has respective arcuate guide surfaces 152 and 94. The roller 150 rides in a cam track 154, formed into a transverse, annular face 160 in the distributor ring 36, and serves to reciprocate the guide 140 radially to bring the guide surfaces 152 into and out of the path of the passageways 42 in the retainer ring.

Figure 2:
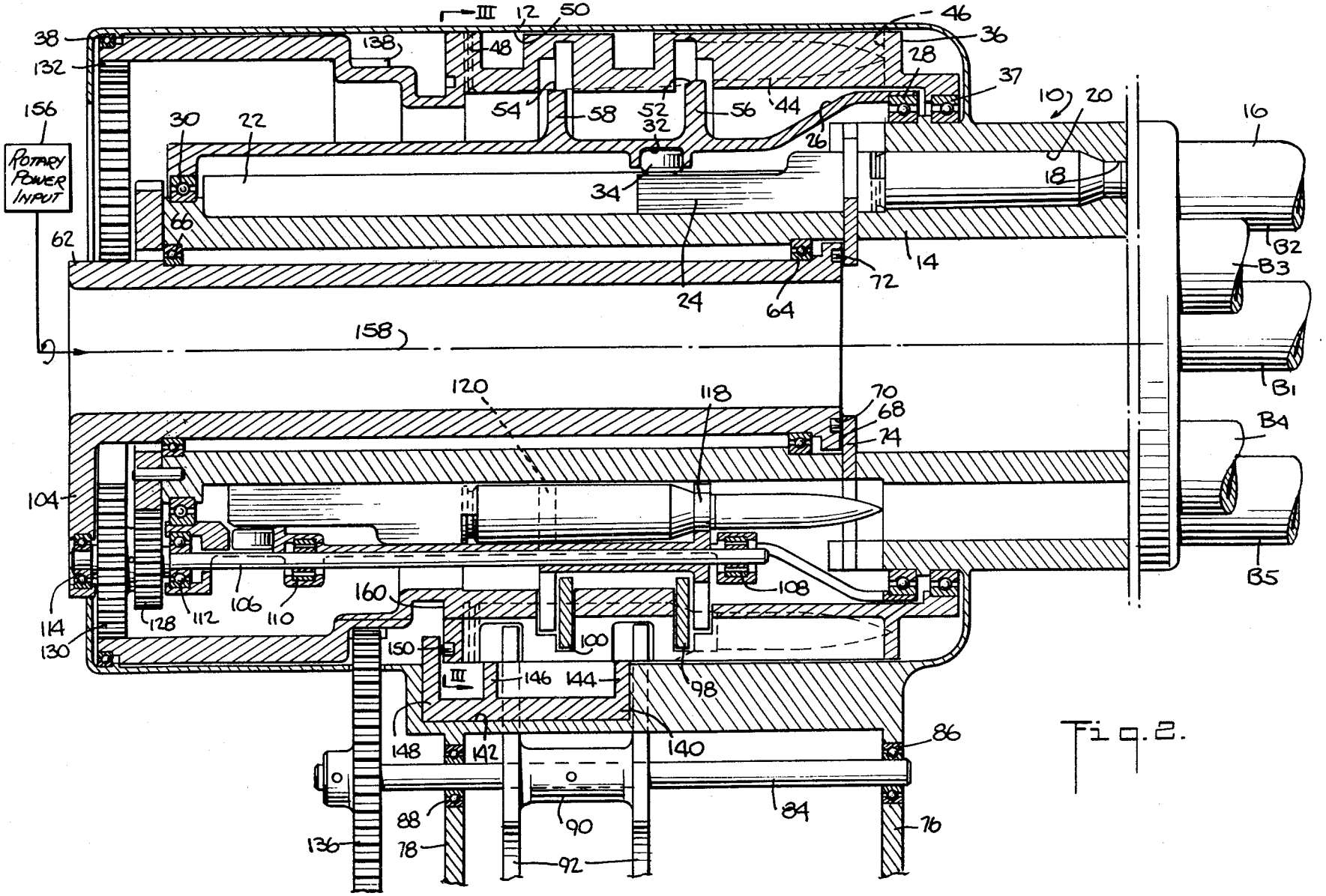
FIG. 2 is a view in longitudinal cross-section of the gun in FIG. 1 taken along a multi-folded plane II—II.

In an externally powered embodiment, a source of rotary power 156 is coupled to the inner drive tube 62 and drives the tube about its longitudinal axis 156 at an angular velocity $w$. The tube 62 carries the shafts 106 and 122, the guide vane assembly 96, and the cylindrical drum 26 about the axis 158 at the same angular velocity $w$. Concurrently, the shafts 106 and 122 are rotated about their respective axes by their respective forward planet gears meshed with the stationary sun gear 126 and respectively rotate the traveling feed sprocket assembly 116 and the traveling eject sprocket assembly 124 about their respective areas. The respective aft planet gears meshed with the ring gear 132 drive the distributor ring 36 about the longitudinal axis at an angular velocity of $2w$. The ring gear 138 meshed with the feeder gear 136 drives the main feeder sprocket assembly 90 at a peripheral velocity equal to the peripheral velocity of the annular row of passageways 42, so that a round of ammunition from each cavity 92 of the feeder sprocket assembly is handed off to every other passageway 42. The cam track 154 shifts the oscillating guide assembly 140 centrifugally for every other passageway to clear the round of ammunition contained therein. As the traveling feed sprocket assembly 116 rides around within the distributor ring 36 at one half the angular velocity of the ring it successively picks each round out of its respective passageway, carries the round about its own sprocket longitudinal axis and hands the round off to a respective bolt 24, as shown in the lower half of FIG. 2. The cam track 32 drives the bolt forward to chamber the round and the cam track 70 shifts the cross-slide 74 to lock the bolt as shown in the upper half of FIG. 2. The round is fired by conventional firing means, such as an electrical distributor circuit. The cam track 70 shifts the cross-slide 74 to unlock the bolt. The cam track 32 drives the bolt aft to extract the fired case. The traveling eject sprocket assembly 124 picks off the fired case from the bolt, carries the case around its own sprocket longitudinal axis and hands the fired case off into an empty passageway 42 in the distributor ring 36. The fired case is carried to the main feeder sprocket assembly as the cam track 150 shifts the oscillating guide 140 centripetally to deflect the fired case from the passageway 42 into a cavity 92 in the feeder sprocket.

The transfer of the rounds and fired cases is accomplished by the traveling feeder and eject sprockets with zero initial and terminal linear velocities, as the theoretical point of contact of a cylinder with a tangential surface is zero. This affords a delicate handling of the rounds, with minimal acceleration loadings.

Figure 4:
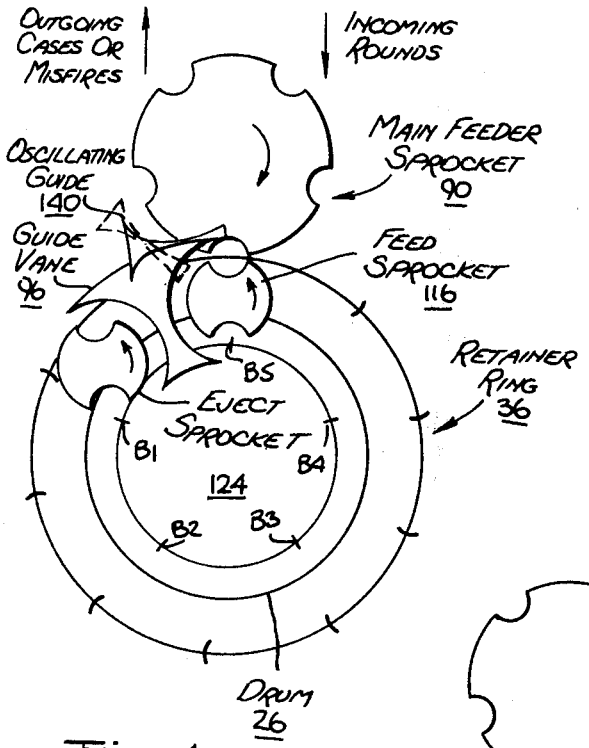
Figure 5:
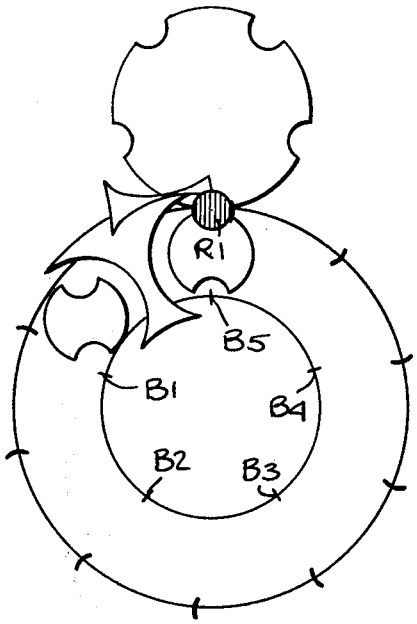
Figure 6:
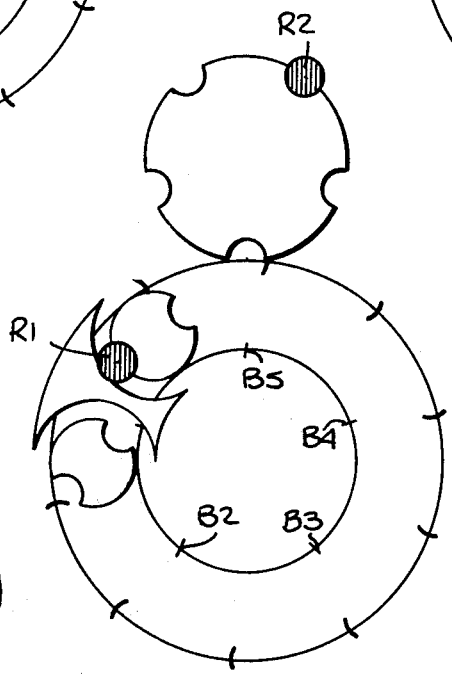
Figure 7:
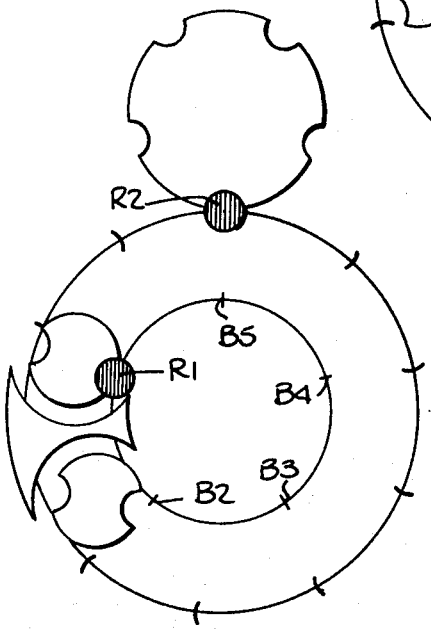
Figure 8:
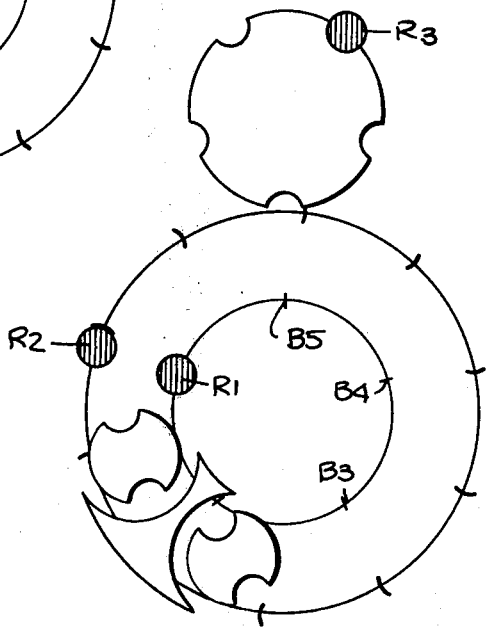
Figure 29:
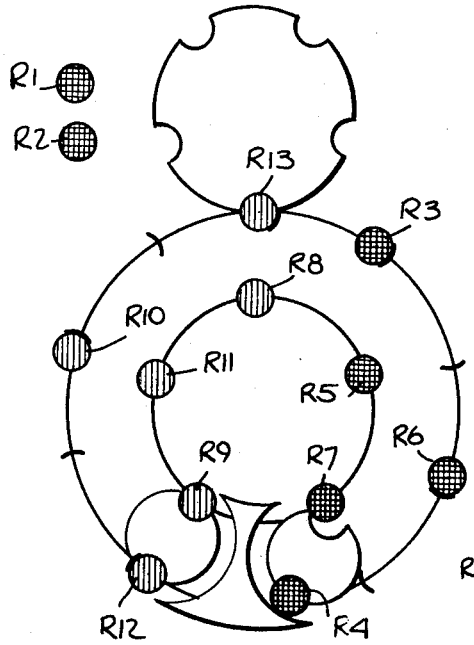
Figure 30:
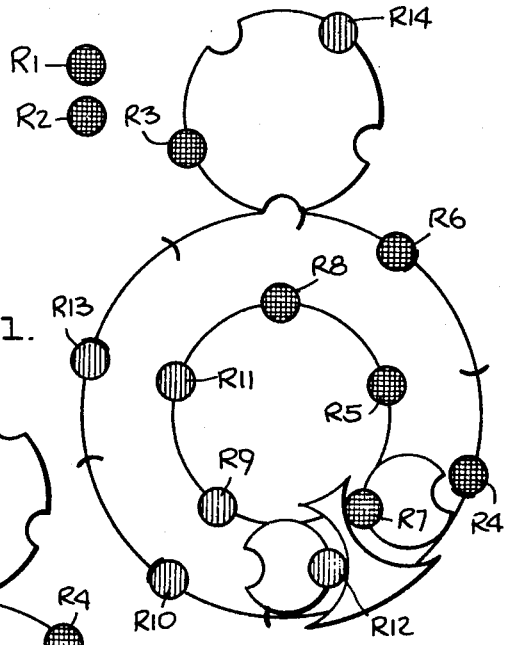
Figure 31:
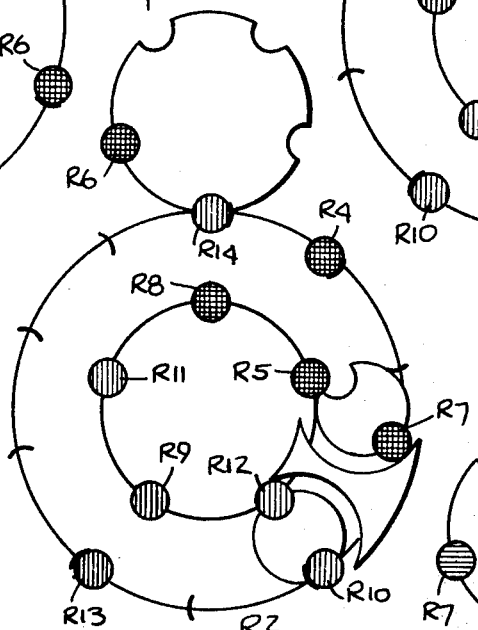
Figure 32:
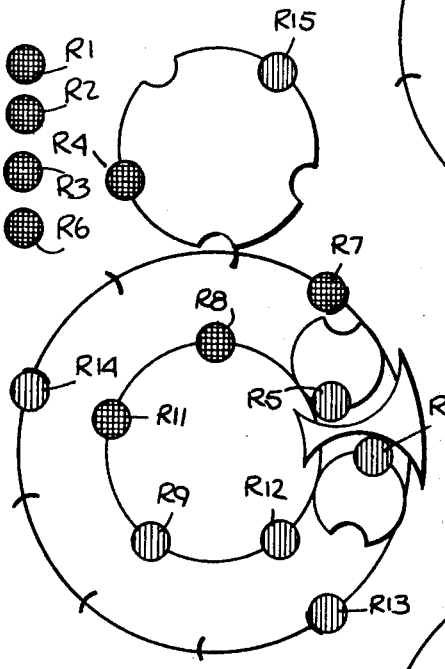
Figure 33:
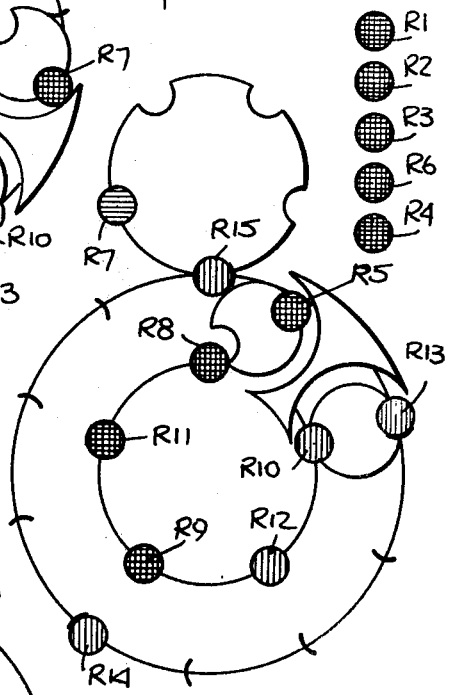
Figure 34:
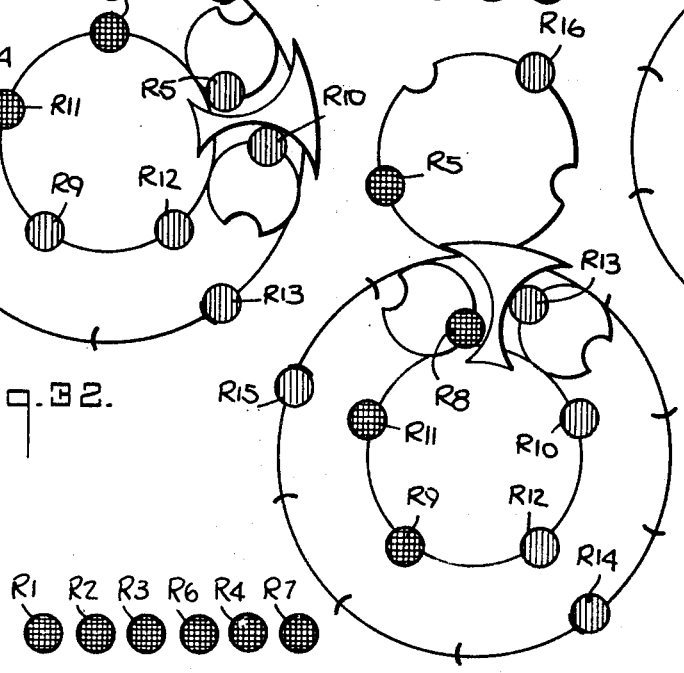

The cycle of operation of the mechanism is shown in FIGS. 4 through 34. FIG. 4 shows the mechanism in starting position. Each successive figure advances the guide vane assembly 96, the traveling feeder sprocket assembly 116 and the traveling eject sprocket assembly 124 by 36°. Since the distributor ring 36 rotates at twice the velocity of the drive tube, each successive figure advances the distributor ring 72°. Since the traveling feeder sprocket and the traveling eject sprocket "roll" around the drive tube, they will each rotate 90° relative to the guide vane. The traveling eject sprocket is $(\frac{3}{4})(360/n)°$ ahead of the traveling feed sprocket, where $n$ is the number of gun barrels. Thus $(\frac{3}{4})(360/5) = 54°$. Since the angular velocity of the distributor ring is twice the angular velocity of the guide vane, the fired cases will always be deposited $(\frac{1}{2})(360/n)°$ or $(\frac{1}{2})(360/5) = 36°$ behind the passageways containing fresh rounds of ammunition. Since the passageways are spaced 36° apart, fired cases and fresh rounds will occupy alternate passageways. Each successive figure also shows the advance of the main feeder sprocket by 144°. A fresh round reaches the sprocket 90 every 288°, or every fourth cavity 92.

FIGS. 4 through 34 describe three complete cycles of the mechanism. During the first cycle gun barrels B2 and B4 do not receive rounds. During each succeeding cycle all gun barrels B1 through B5 receive rounds. The successive rounds are numbered R1 through R16. Live rounds are cross-hatched and fired cases are double-cross-hatched.

What is claimed is:

1. An article handling system including:

a plurality of work stations disposed in an annular row about a central axis;

a distributor ring journaled for rotation about said central axis and having a first plurality of first pockets disposed in an annular row about said central axis, and a second plurality of second pockets disposed in an annular row about said central axis, said first and said second pluralities of pockets being in congruent annular rows and alternately interspaced;

feeding means for receiving work pieces from a supply and for providing these work pieces to said first plurality of pockets in a train; and transfer means journaled for rotation about said central axis and having first means for transferring work pieces from said first plurality of pockets to said work stations, and second means for transferring work pieces from said work stations to said second plurality of pockets, said first means of said transfer means including a first sprocket journaled for rotation about its own axis and for traveling along a path concentric with said central axis, and said second means of said transfer means including a second sprocket journaled for rotation about its own axis and for traveling along a path concentric with said central axis;

said feeding means including a feeder sprocket; and said transfer means further including:

guide means journaled for oscillation between a first position wherein it guides a work piece from said feeder sprocket into said first sprocket, and a second position wherein it guides a work piece from said second sprocket into said feeder sprocket.

2. A system according to claim 1 further including:

means for driving said distributor ring, for driving said transfer means about said central axis at twice the angular rate of said distributor ring, for driving said first and second sprockets about their respective axes, and for oscillating said guide means.

3. An article handling system comprising:

a housing;

a plurality of work stations disposed on said housing in an annular row about a central axis, each station having a respective work piece receiving means;

a work piece distributor ring journaled to said housing for rotation about said central axis, said ring having a first plurality of first pockets disposed in an annular row about said central axis, and a second plurality of second pockets disposed in an annular row about said central axis;

a feeder sprocket journaled to said housing for rotation about an additional axis for receiving fresh work pieces and for discharging worked work pieces;

guide means journaled to said housing for oscillation between a first position wherein it guides a fresh work piece from said feeder sprocket into one of said first pockets, and a second position wherein it guides a worked work piece from one of said second pockets into said feeder sprocket; and transfer means journaled to said housing for rotation about said central axis and having first means for transferring fresh work pieces from said first plurality of pockets to said work piece receiving means, and second means for transferring worked work pieces from said work piece receiving means to said second plurality of pockets.

4. A system according to claim 3 further including:

a cam follower coupled to said guide means; and a cam driver journaled to said housing for rotation about said central axis for driving said cam follower.

5. A system according to claim 3 further including:

drive means for rotating said distributor ring, for rotating said transfer means at twice the angular rate of said distributor ring, and for oscillating said guide means.

6. An article handling system comprising:

a housing:

a plurality of work stations disposed on said housing in an annular row about a central axis, each station having a respective work piece receiving means;

a work piece distributor ring journaled to said housing for rotation about said central axis, said ring having a first plurality of first pockets disposed in an annular row about said central axis, and a second plurality of second pockets disposed in an annular row about said central axis;

a feeder sprocket journaled to said housing for rotation about an additional axis for receiving fresh work pieces and for discharging worked work pieces;

guide means coupled to said housing for guiding fresh work pieces from said feeder sprocket into said first plurality of first pockets and for guiding worked work pieces from said second plurality of second pockets into said feeder sprocket; and transfer means journaled to said housing for rotation about said central axis and having first means for transferring fresh work pieces from said first plurality of pockets to said work piece receiving means, and second means for transferring worked work pieces from said work piece receiving means to said second plurality of pockets;

said first means of said transfer means including a first sprocket journaled for rotation about its own axis and for traveling along a path which is concentric with said central axis, and for directly cooperating with said first plurality of pockets and for cooperating with said work piece receiving means; and said second means of said transfer means including a second sprocket journaled for rotation about its own axis and for traveling along a path which is concentric with said central axis, and for directly cooperating with said second plurality of pockets and for cooperating with said work piece receiving means.

* * * * *